US012016437B2

(12) United States Patent
Richter et al.

(10) Patent No.: US 12,016,437 B2
(45) Date of Patent: Jun. 25, 2024

(54) CHARM STRAP

(71) Applicant: Lug USA LLC, Orlando, FL (US)

(72) Inventors: Jason Richter, Orlando, FL (US); Ami Richter, Orlando, FL (US)

( * ) Notice: Subject to any disclaimer, the term of this patent is extended or adjusted under 35 U.S.C. 154(b) by 0 days.

(21) Appl. No.: 18/141,260

(22) Filed: Apr. 28, 2023

(65) Prior Publication Data

US 2023/0346088 A1 Nov. 2, 2023

Related U.S. Application Data

(60) Provisional application No. 63/336,403, filed on Apr. 29, 2022.

(51) Int. Cl.
*A44C 25/00* (2006.01)
*A45C 13/08* (2006.01)

(52) U.S. Cl.
CPC ..... *A44C 25/007* (2013.01)

(58) Field of Classification Search
CPC ..... A44C 25/007; A44C 15/00; A44C 13/00; A44C 5/0053; A45C 3/06; A45C 13/08; A45C 1/02; A45C 13/001; A45C 2013/306
See application file for complete search history.

(56) References Cited

U.S. PATENT DOCUMENTS

| | | | | |
|---|---|---|---|---|
| 7,421,980 | B1 * | 9/2008 | Ehlers | A01K 27/006 119/858 |
| 10,470,531 | B1 | 11/2019 | Yanes | |
| 10,485,310 | B2 * | 11/2019 | Harris | A44C 17/0241 |
| 11,690,357 | B2 * | 7/2023 | Broshat | A01K 27/001 119/858 |
| 2007/0186455 | A1 * | 8/2007 | Lin | G09F 23/00 40/640 |
| 2014/0093850 | A1 | 4/2014 | Georgi | |
| 2014/0283551 | A1 * | 9/2014 | Ciprari | A44C 15/00 63/43 |
| 2015/0089975 | A1 * | 4/2015 | Paleschuck | G09F 23/00 63/1.13 |
| 2018/0144648 | A1 | 5/2018 | Naqvi | |
| 2018/0303214 | A1 * | 10/2018 | Harris | A45C 3/06 |
| 2021/0045358 | A1 | 2/2021 | Broshat | |

FOREIGN PATENT DOCUMENTS

| | | | | |
|---|---|---|---|---|
| JP | H0369423 U | * | 11/1989 | |
| KR | 20120005688 | * | 8/2012 | A45C 11/32 |

* cited by examiner

*Primary Examiner* — Jack W Lavinder
(74) *Attorney, Agent, or Firm* — Meister Seelig & Fein PLLC

(57) ABSTRACT

A strap system configured to be mounted to an accessory includes a strap having a first end and a second end disposed opposite the first end, an attachment point configured to attach the first end of the strap body to the accessory, a lock configured to attach the second end of the strap body to the accessory, and one or more charms configured to fit onto the strap.

11 Claims, 8 Drawing Sheets

CHARM STRAP

CROSS-REFERENCE TO RELATED APPLICATIONS

This application claims priority under 35 U.S.C. § 120 from U.S. Patent application Ser. No. 63/336,403, filed on Apr. 29, 2023 in the United States Patent and Trademark Office, the disclosure of which is incorporated herein in its entirety by reference.

BACKGROUND OF THE INVENTION

Consumer apparel and accessories, including purses, backpacks, hats, and the like, are in common use. Since many such accessories are mass-produced, users often want to add individuality to their accessories. Such users will customize their accessories with personal touches, for example their initials, the logo of their favorite sports team, etc.

Currently available options for customizing accessories include permanently embroidering or engraving the selected features onto the accessory, as well as more temporary customizations including pins, key chains, and temporary patches affixed with, e.g., hook-and-loop fasteners such as Velcro™.

These methods of customization have multiple drawbacks. Permanent customizations are difficult to remove or change if the user ever changes their preferences or if the accessory changes owners. Temporary customizations may damage the accessory, for example a pin that punctures a hole through the accessory. Temporary customizations may also fail unexpectedly, for example if the back of a pin becomes loose, causing the pin, patch, or other feature to fall off and be lost.

There is accordingly a need for an accessory which addresses some or all of these drawbacks.

SUMMARY OF THE INVENTION

Exemplary embodiments of the present general inventive concept provide a charm strap which may be affixed to an accessory, one or more charms configured to slide onto the strap, and a method of using the same.

The foregoing and/or other features and utilities of the present general inventive concept may be achieved by providing a strap system configured to be mounted to an accessory, the system comprising: a strap having a first end and a second end disposed opposite the first end, an attachment point configured to attach the first end of the strap to the accessory, a lock configured to attach the second end of the strap to the accessory, and one or more charms configured to fit onto the strap.

In an exemplary embodiment, the attachment point may be configured to separably attach the first end of the strap to the accessory.

In an exemplary embodiment, each of the one or more charms may comprise a body including a slot configured to fit onto the strap, and a front configured to face away from the accessory when the charm is fit onto the strap.

In an exemplary embodiment, each of the one or more charms may further include a back configured to face towards the accessory when the charm is fit onto the strap.

In an exemplary embodiment, at least one of the one or more charms may further include a cord extending away from the body of the charm. The front and back of each of the one or more charms may be connected to the body of the charm via the cord.

In an exemplary embodiment, the front and back of at least one of the one or more charms may comprise separate pieces attached to the body of the charm.

In an exemplary embodiment, the front of at least one of the one or more charms may be integrated into the body of the charm.

In an exemplary embodiment, the lock may include a stud mounted to the accessory, the stud being configured to be inserted through a hole in the strap.

In an exemplary embodiment, the lock may attach the second end of the strap to the accessory with friction between the stud and the hole.

In an exemplary embodiment, at least one of a size and shape of the strap may be set based on the accessory.

The foregoing and/or other features and utilities of the present general inventive concept may be achieved by providing a strap configured to mount one or more charms to an accessory, the strap including a strap body configured to fit into a slot of each of the one or more charms, an attachment point configured to attach a first end of the strap body to the accessory, and a lock configured to attach a second end of the strap body to the accessory, the second end of the strap body being disposed at an opposite end of the strap body from the first end.

The foregoing and/or other features and utilities of the present general inventive concept may be achieved by providing a method of attaching one or more charms to an accessory, the method including providing a strap attached to the accessory at an attachment point disposed at a first end of the strap, bending the strap away from the accessory, sliding the strap into a slot disposed in each of the one or more charms, and affixing a second end of the strap to the accessory with a lock disposed at the second end of the strap, the second end of the strap being disposed at an opposite end of the strap from the first end.

Additional features and utilities of the present general inventive concept will be set forth in part in the description which follows and, in part, will be obvious from the description, or may be learned by practice of the general inventive concept.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF EXEMPLARY EMBODIMENTS OF THE INVENTIVE CONCEPT

Figure 1:
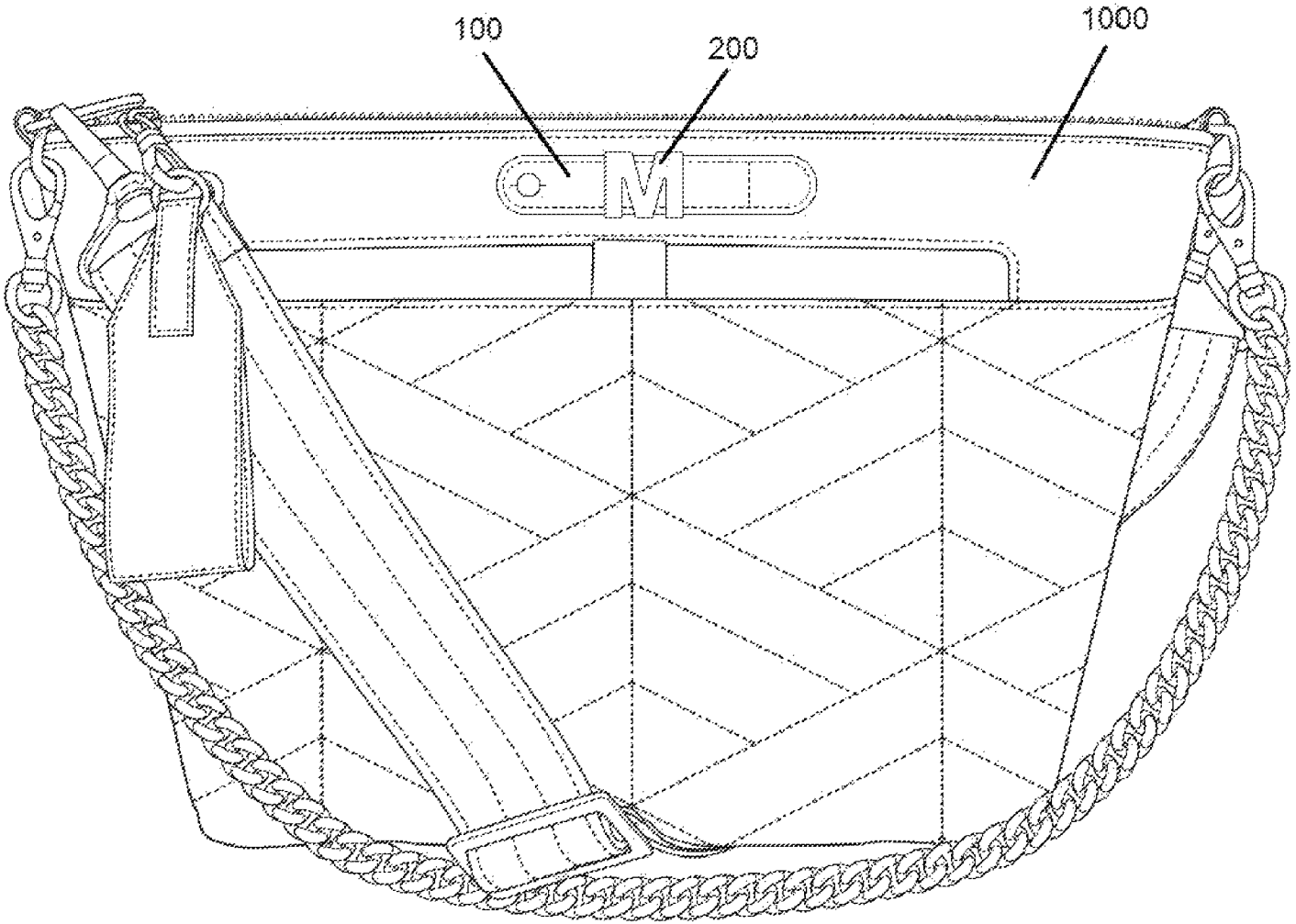
FIG. 1 illustrates a view of a strap and charm affixed to an accessory according to an exemplary embodiment of the present general inventive concept.

Reference will now be made in detail to embodiments of the present general inventive concept, examples of which are illustrated in the accompanying drawings, wherein like reference numerals refer to the like elements throughout. The embodiments are described below in order to explain the present general inventive concept while referring to the figures. Also, while describing the present general inventive concept, detailed descriptions about related well-known functions or configurations that may diminish the clarity of the points of the present general inventive concept are omitted.

Expressions such as "at least one of," when preceding a list of elements, modify the entire list of elements and do not modify the individual elements of the list.

All terms including descriptive or technical terms which are used herein should be construed as having meanings that are obvious to one of ordinary skill in the art. However, the terms may have different meanings according to an intention of one of ordinary skill in the art, case precedents, or the appearance of new technologies. Also, some terms may be arbitrarily selected by the applicant, and in this case, the meaning of the selected terms will be described in detail in the detailed description of the invention. Thus, the terms used herein have to be defined based on the meaning of the terms together with the description throughout the specification.

Also, when a part "includes" or "comprises" an element, unless there is a particular description contrary thereto, the part can further include other elements, not excluding the other elements.

Hereinafter, one or more exemplary embodiments of the present general inventive concept will be described in detail with reference to accompanying drawings.

FIG. 1 illustrates a strap system according to an exemplary embodiment of the present general inventive concept, including a strap 100 which may interact with one or more charms 200. As illustrated in FIG. 1, the strap 100 may be affixed to an accessory 1000. The accessory 1000 may be, e.g., a bag, an article of clothing, etc. It will be understood that the accessory 1000 illustrated in the drawings is provided only as an example. Different sizes and shapes of accessory 1000 may be used without departing from the present general inventive concept.

According to exemplary embodiments of the present general inventive concept, the strap 100 may have a similar design as the accessory 1000. For example, if the accessory 1000 includes a shoulder strap, the strap 100 may be a similar color and appearance as the shoulder strap, such that the strap 100 appears consistent with the accessory 1000.

Figure 2A:
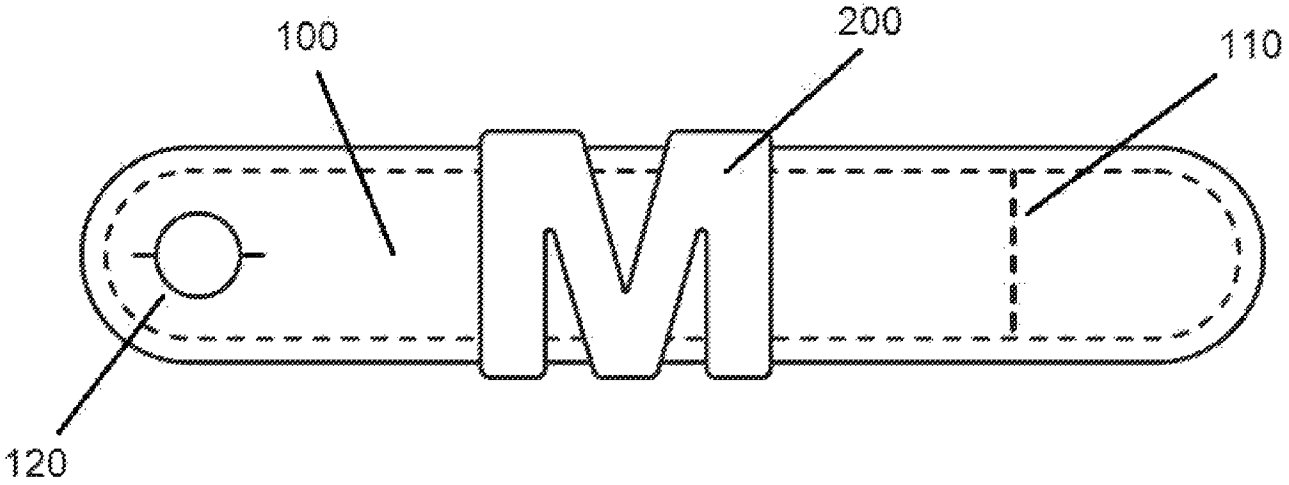
FIG. 2A illustrates a strap and a charm according to an exemplary embodiment of the present general inventive concept.
Figure 2B:
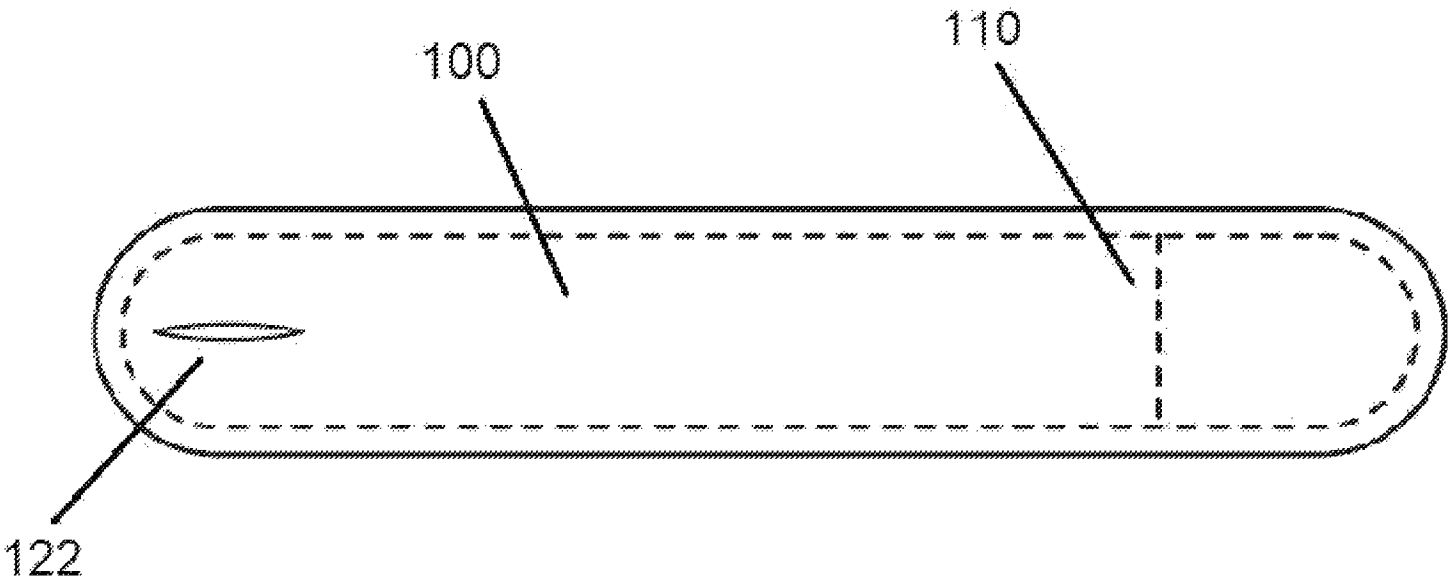
FIG. 2B illustrates a strap without a charm according to an exemplary embodiment of the present general inventive concept.

FIGS. 2A and 2B illustrate the strap 100 with and without a charm 200, respectively. According to exemplary embodiments of the present general inventive concept, the strap 100 may comprise a flexible material, for example silicone, leather, vegan leather, or rubber. The material of the strap 100 may be one with a high coefficient of friction, such that objects placed on it do not slide off easily. The strap 100 may be affixed to the accessory 1000 at an attachment point 110 disposed at a first end of the strap 100. This attachment point 110 may comprise, for example, stitching, glue, or another similar method of attaching the strap 100 to the accessory 1000. The attachment point 110 is illustrated in dashed lines to indicate stitching as a possible method of attachment. Similarly, dashed lines going around the perimeter of strap 100 indicate stitching going around the strap 100. Such perimeter stitching may be cosmetic and/or structural, for example strengthening the edges of the strap 100, holding multiple layers of material together to form the strap 100, etc.

Figure 2C:
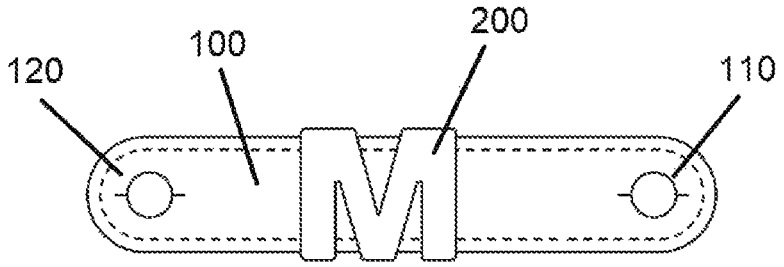
FIG. 2C illustrates a strap according to another exemplary embodiment of the present general inventive concept.

The attachment point 110 may anchor the first end of the strap 100 to the accessory 1000 such that the strap 100 may be bent away from the accessory 1000 in order to fit one or more charms 200 onto the strap 100. According to exemplary embodiments of the present general inventive concept, the attachment point 110 may be permanent, e.g. comprising stitching or other persistent attachment so that the strap 100 may not be removed or accidentally dislodged from the accessory 1000. According to other exemplary embodiments of the present general inventive concept, the attachment point 110 may be removable, e.g. comprising a rivet, stud, snap, button, or similar structure, allowing the strap 100 to be completely removed from the accessory 1000 if desired. Such an exemplary embodiment is illustrated in FIG. 2C.

Figure 3:
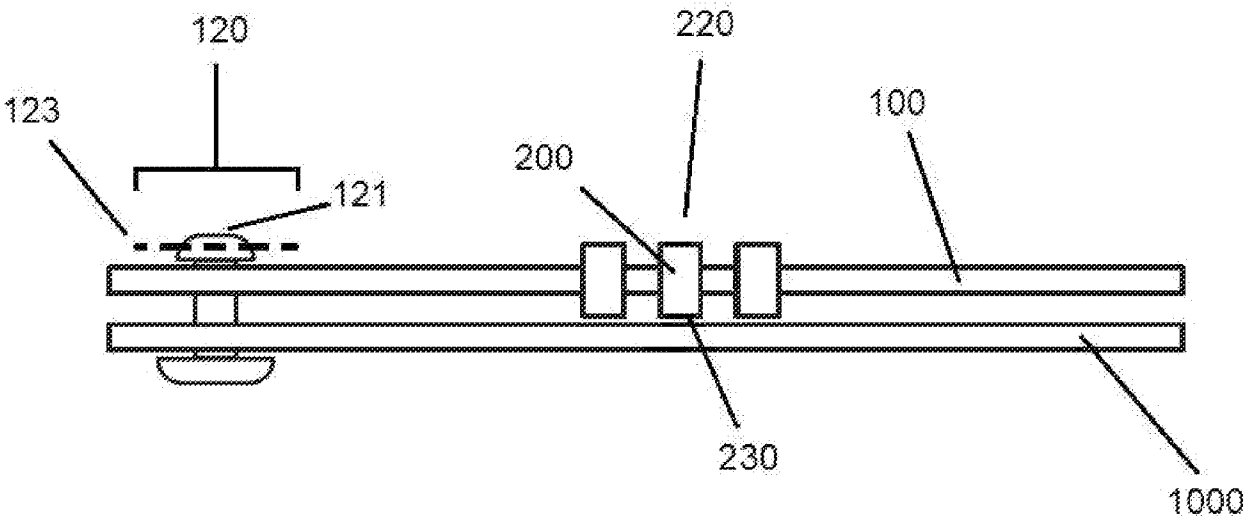
FIG. 3 illustrates a top view of a strap and charm affixed to a wall of an accessory according to an exemplary embodiment of the present general inventive concept.

FIG. 3 is a top view of the strap 100 and charm 200 affixed to a wall of the accessory 1000 according to an exemplary embodiment of the present general inventive concept. As illustrated therein, the strap 100 may be separably affixed to the accessory 1000 at a lock 120 disposed at a second end of the strap 100 opposite the first end. According to exemplary embodiments of the present general inventive concept, the lock 120 may comprise an anchor point 121 and a hole 122 (illustrated in FIG. 2B). The anchor point 121 may include, e.g., a tab, pin, stud, rivet, or similar feature which is affixed to the accessory 1000, and may be made of a rigid material, for example metal or plastic. The hole 122 may be formed in the strap 100, and may stretch to allow the anchor point 121 to pass therethrough. The anchor point 121 may have a size such that it may be pushed through the hole 122 by a user, but will not pass through the hole 122 without external force. In operation, a user may insert the anchor point 121 through the hole 122 of the strap 100 in order to hold the strap 100 against the accessory 1000, and as desired may pull the anchor point 121 back through the hole 122 to disengage the lock 120 and allow the strap 100 to be moved away from the accessory 1000.

According to exemplary embodiments of the present general inventive concept, the lock 120 may secure the strap 100 in place solely with friction, e.g., the anchor point 121 comprises a flared head of a stud which may not pass through the hole 122 without external force from a user. Such an exemplary embodiment is illustrated in FIG. 3. According to other exemplary embodiments, the anchor point 121 may include additional security measures, e.g., a pin 123 inserted through a stud, to keep the strap 100 from unintentionally sliding off of the anchor point 121. Such a pin 123 is illustrated in FIG. 3 as a dashed line to indicate that it is removable from the anchor point 121, and furthermore may not be included in every exemplary embodiment of the present general inventive concept. According to exemplary embodiments of the present general inventive concept, the hole 122 may be formed such that it is flush with the body of the strap 100, so that if a charm 200 is fit onto the strap 100 as described below, the hole 122 will not interfere with the charm 200.

Figure 2D:
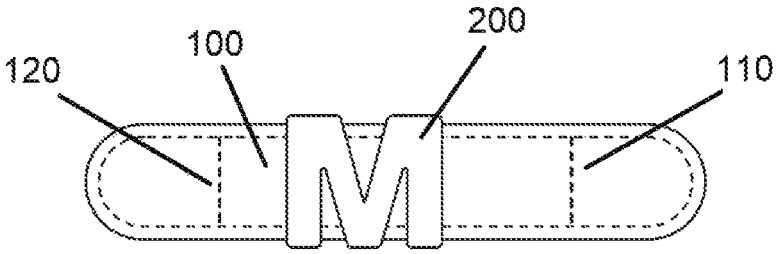
FIG. 2D illustrates a strap according to another exemplary embodiment of the present general inventive concept.

It will be understood that different exemplary embodiments of the present general inventive concept may use different mechanisms as the lock 120. For example, the lock 120 may comprise a button, a snap, or similar structure used to affix the second end of the strap 100 to the accessory 1000. According to other exemplary embodiments of the present general inventive concept, the lock 120 may comprise, for example, glue or stitching that affixes the strap 100 to the accessory 1000 until the lock 120 can be removed by a user, for example by separating the stitching or removing the glue. Such an exemplary embodiment of the present general inventive concept is illustrated in FIG. 2D. According to exemplary embodiments of the present general inventive concept, the lock 120 may hold the strap 100 in place strongly enough to support a plurality of charms 200 and/or external objects, for example a user's sunglasses, without the weight of the charms 200 and/or external objects disengaging the lock 120.

Figure 4A:
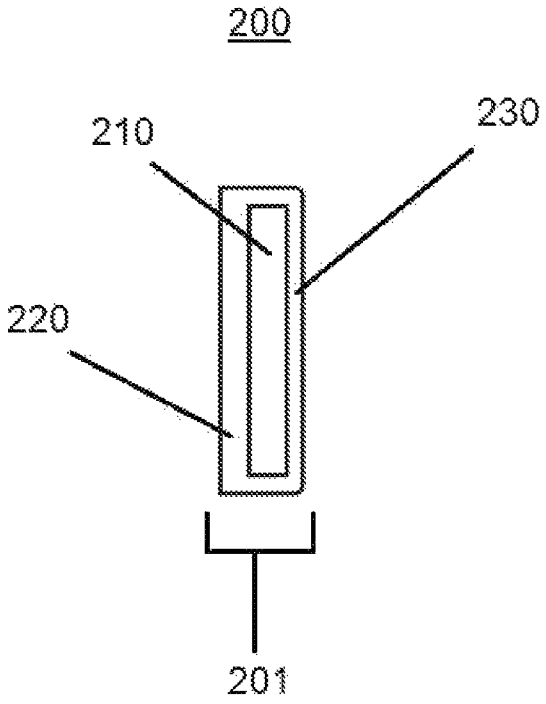
FIG. 4A illustrates a side view of a charm according to an exemplary embodiment of the present general inventive concept.
Figure 4B:
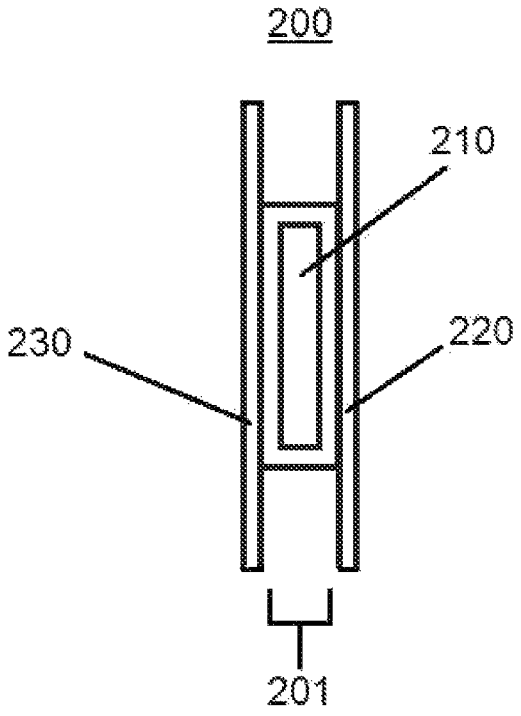
FIG. 4B illustrates a side view of a charm according to another exemplary embodiment of the present general inventive concept.

Each charm 200 may comprise any physical item which may fit onto the strap 100. FIGS. 4A and 4B illustrate side views of charm 200 according to exemplary embodiments of the present general inventive concept. As illustrated therein, the charm 200 may include a body 201 including a slot 210. Each charm 200 may further include a front 220, the front 220 being configured to face away from the accessory 1000 when the charm 200 is placed on the strap 100. According to exemplary embodiments of the present general inventive concept, the charm 200 may also include a back 230 configured to face towards the accessory 1000 when the charm 200 is placed on the strap 100. According to exemplary embodiments of the present general inventive concept, each charm 200 may be made of a rigid material, for example metal or plastic. Each charm 200 may also be any size suitable to fit on the strap 100.

The slot 210 may be a cavity formed in a body 201 of the charm 200, this cavity having a size and shape suitable to accept the strap 100. In operation, the strap 100 may be inserted through the slot 210 in order to fit the charm 200 onto the strap 100. The front 220 may be a portion of the charm 200 meant to be displayed, and may be shaped as any desired feature, including numbers, letters, logos, images, etc. According to exemplary embodiments of the present general inventive concept, the front 220 may include one or more desired colors to provide an intended appearance for the charm 200.

According to exemplary embodiments of the present general inventive concept, the back 230 of charm 200 may have the same shape as the front 220, or a different shape. The back 230 may have a different color, texture, or thickness than the front 220, or alternatively may be made as an exact copy of the front 220, including shape, color, texture, and thickness, such that the charm 200 presents the same features on both the front 220 and back 230.

Figure 2E:
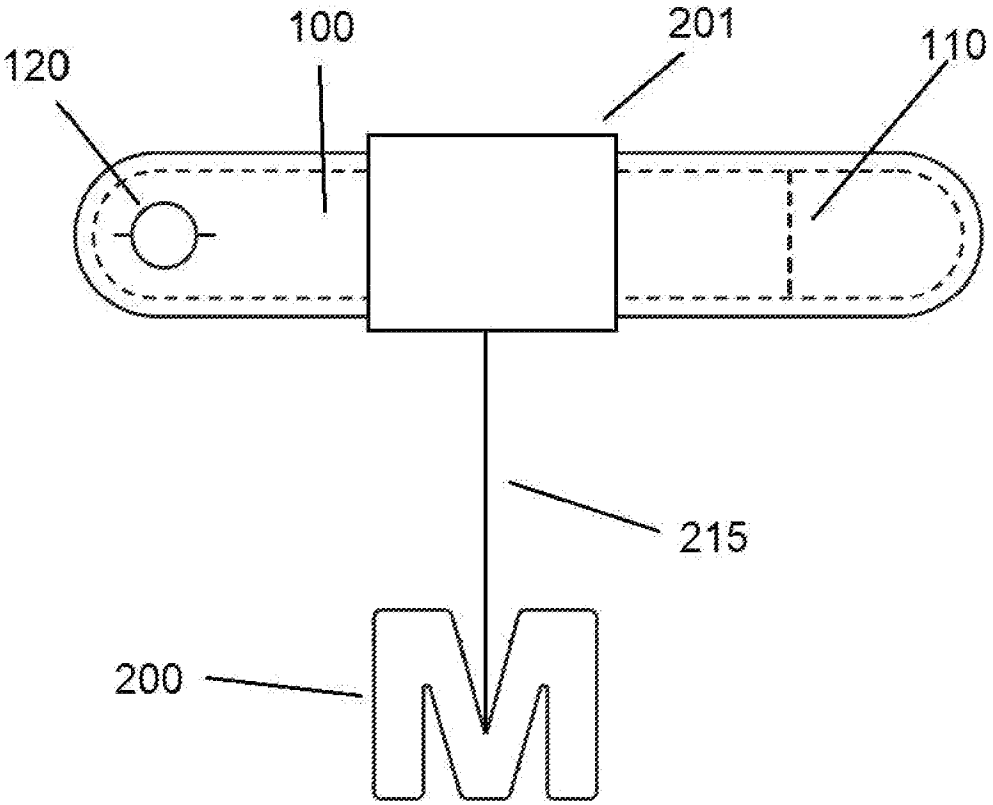
FIG. 2E illustrates a strap with a charm according to another exemplary embodiment of the present general inventive concept.

According to exemplary embodiments of the present general inventive concept, the front 220 and the back 230 of the charm may be integrated into the body 201 of the charm 200, such that the charm 200 is a block with the slot 210 formed approximately in the middle, as illustrated in FIG. 4A. A front view of such a charm according to an exemplary embodiment of the present general inventive concept is illustrated for example in the FIG. 2A. Alternatively, the front 220 and back 230 may be separate pieces attached to the body 201 of the charm 200 including the slot 210, as illustrated in FIG. 4B. According to other exemplary embodiments, the body 201 of the charm 200, including slot 210, may be disposed away from the front 220 and back 230. For example, the front 220 and back 230 may be configured to connected to the body 201 of the charm 200 via a cord 215, such that the front 220 and back 230 dangle from the charm body 201, while the slot 210 may be slid onto the strap 100 as described above. An exemplary embodiment of such a charm 200 including a cord 215 is illustrated in FIG. 2E. The cord 215 may comprise, e.g., a chain, string, or similar apparatus, while the slot 210 may be slid onto the strap 100 as described above.

According to exemplary embodiments of the present general inventive concept, the slot 210 may have a size and shape suitable to fit onto the strap 100. If the front 220 and back 230 are separate pieces, as in the exemplary embodiment illustrated in FIG. 4B, the front 220 and back 230 may be a different size than the charm body 201, i.e., the front 220 and back 230 may be substantially smaller or larger than charm body 201.

The charm 200 may be held on the strap 100 with friction. For example, the slot 210 may be sized to create an interference fit, e.g., the slot 210 may be slightly smaller than the strap 100, such that friction is generated to hold the charm 200 on the strap 100. When the lock 120 is engaged and the strap 100 is secured against the accessory 1000 as illustrated in FIG. 3, the strap 100 may be held under tension such that the back 230 of charm 200 is also pressed against the accessory 1000. This pressure may generate friction between the back 230 and the accessory 1000 to thereby hold the charm 200 on the strap 100. Since friction and pressure hold the one or more charms 200 in place without a need for a more permanent method of attachment, each charm 200 may be removed at will by pulling it off of the strap 100. The charms 200 may therefore be interchangeable according to the user's desires.

The dimensions of the strap 100 may be set according to the accessory 1000. For example, in one exemplary embodiment of the present general inventive concept the strap 100 may be affixed to a hat. Such a strap 100 may be wider or longer than a strap 100 affixed to, e.g., a small purse. Furthermore, the strap 100 may have any desired shape or cross-section, e.g., flat, round, rectangular, etc. The slot 210 of the one or more charms 200 may be formed with a shape to match the shape of the strap 100.

The strap 100 may have a length suitable to accommodate a plurality of charms 200. In operation, one or more charms 200 may be fit onto the strap 100 by inserting the strap 100 through the slot 210 of each charm 200. After being fit onto the strap 100 each charm 200 may be slid to a desired location along the length of the strap 100. The strap 100 may thereafter be affixed in place with the lock 120. To remove a charm 200, the strap 100 may be detached from the accessory 1000 by disengaging the lock 120, after which any number of charms 200 may be slid off of the strap 100. According to an exemplary embodiment in which the lock 120 comprises stitching, glue, or other long-term attachment, one or more charms 200 may be slid onto the strap 100 before the lock 120 is applied, so that the charms 200 on the strap 100 are held firmly in place on the strap 100.

According to an exemplary embodiment of the present general inventive concept, the one or more charms 200 may be a uniform size, i.e., similar width, height, and depth. In such an exemplary embodiment the charms 200 may be, for example, numbers or letters, allowing a user to spell a desired word or phrase. According to other exemplary embodiments, the charms 200 may have different dimensions. In such an exemplary embodiment the charms 200 may be, for example, logos or pictures which may have varying sizes.

The strap 100 according to exemplary embodiments of the present general inventive concept may permit customization of the accessory 1000, allowing the user to quickly change which charms 200 are mounted to the accessory 1000. The strap 100 may be mounted to the accessory 1000 via attachment point 110, thereby minimizing the risk of the strap 100 falling off. Furthermore, the charms 200 may be quickly replaced or changed according to the preferences of the user. The user may mount different charms 200 of different styles, provided the slot 210 of each charm fits onto the strap 100.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A strap system configured to be mounted to an accessory, the system comprising:

a strap having a first end and a second end disposed opposite the first end, the strap being permanently attached to the accessory at an attachment point disposed at the first end;

a lock configured to attach the second end of the strap to the accessory; and one or more charms configured to fit onto the strap, wherein the one or more charms are held in place on the strap via friction between each charm and the accessory.

2. The system of claim 1, wherein each of the one or more charms comprises a body including a slot configured to fit onto the strap, and a front configured to face away from the accessory when the charm is fit onto the strap.

3. The system of claim 2, wherein the front of at least one of the one or more charms is integrated into the body of the charm.

4. The system of claim 2, wherein each of the one or more charms further comprises a back configured to face towards the accessory when the charm is fit onto the strap.

5. The system of claim 4, wherein at least one of the one or more charms further comprises a cord extending away from the body of the charm, and wherein the front and back of each of the one or more charms are connected to the body of the charm via the cord.

6. The system of claim 4, wherein the front and back of at least one of the one or more charms comprise separate pieces attached to the body of the charm.

7. The system of claim 1, wherein the lock comprises a stud mounted to the accessory, the stud being configured to be inserted through a hole in the strap.

8. The system of claim 7, wherein the lock attaches the second end of the strap to the accessory with friction between the stud and the hole.

9. The system of claim 1, wherein at least one of a size and shape of the strap is set based on the accessory.

10. The system of claim 1, wherein the one or more charms are configured to have an interference fit between the strap and the charm.

11. A method of attaching one or more charms to an accessory, the method comprising:

providing a strap permanently attached to the accessory at an attachment point disposed at a first end of the strap;

bending the strap away from the accessory;

sliding the strap into a slot disposed in each of the one or more charms;

affixing a second end of the strap to the accessory with a lock disposed at the second end of the strap, the second end of the strap being disposed at an opposite end of the strap from the first end; and holding the one or more charms in place on the strap via friction between each charm and the accessory.

* * * * *